US009611719B2

(12) United States Patent
Hofman et al.

(10) Patent No.: US 9,611,719 B2
(45) Date of Patent: Apr. 4, 2017

(54) DOWNHOLE TOOL

(71) Applicant: Peak Completion Technologies, Inc., Midland, TX (US)

(72) Inventors: Raymond Hofman, Midland, TX (US); William Sloane Muscroft, Midland, TX (US)

(73) Assignee: Peak Completion technologies, Inc., Midland, TX (US)

( * ) Notice: Subject to any disclaimer, the term of this patent is extended or adjusted under 35 U.S.C. 154(b) by 455 days.

(21) Appl. No.: 14/086,900

(22) Filed: Nov. 21, 2013

(65) Prior Publication Data

US 2014/0076578 A1 Mar. 20, 2014

Related U.S. Application Data

(63) Continuation-in-part of application No. 13/462,810, filed on May 2, 2012, now Pat. No. 9,133,684.

(60) Provisional application No. 61/729,264, filed on Nov. 21, 2012, provisional application No. 61/481,483, filed on May 2, 2011.

(51) Int. Cl.

| | |
|---|---|
| ***E21B 34/10*** | (2006.01) |
| ***E21B 34/06*** | (2006.01) |
| ***E21B 23/00*** | (2006.01) |
| *E21B 34/00* | (2006.01) |

(52) U.S. Cl.

CPC ..... *E21B 34/10* (2013.01); *E21B 23/006* (2013.01); *E21B 34/063* (2013.01); *E21B 34/103* (2013.01); *E21B 2034/007* (2013.01)

(58) Field of Classification Search

CPC .. E21B 2034/007; E21B 34/063; E21B 34/10; E21B 34/102; E21B 34/103

See application file for complete search history.

(56) References Cited

U.S. PATENT DOCUMENTS

| | | | | |
|---|---|---|---|---|
| 2,251,977 | A | 8/1941 | Burt | |
| 4,429,747 | A * | 2/1984 | Williamson, Jr. | E21B 34/14 166/321 |
| 4,515,217 | A | 5/1985 | Strout | |
| 4,609,005 | A | 9/1986 | Upchurch | |
| 5,261,486 | A | 11/1993 | Cornette et al. | |
| 6,286,594 | B1 | 9/2001 | French | |
| 6,293,342 | B1 | 9/2001 | McGarian et al. | |

(Continued)

*Primary Examiner* — Blake Michener

(57) ABSTRACT

A downhole tool comprising an inner sleeve with a plurality of sleeve ports and a housing positioned radially outwardly of the inner sleeve and having a plurality of housing ports, with the housing and inner sleeve partially defining a space radially therebetween. The space is occupied by a shifting sleeve. A fluid path extends between the interior flowpath of the tool and the space. A fluid control device, such as a burst disk, occupies at least portion of the fluid path. In one state, the shifting sleeve is in a first position between the housing ports and the sleeve ports to prevent fluid flow between the interior flowpath and exterior of the tool. The fluid control device may selectively permit fluid flow, and thus pressure communication, into the annular space to cause a differential pressure across the shifting sleeve. When a sufficient differential pressure is reached, the shifting sleeve is moved to a second position, which opens the communication paths through the housing and sleeve ports between the interior flowpath and exterior flowpath of the tool.

14 Claims, 16 Drawing Sheets

(56) References Cited

U.S. PATENT DOCUMENTS 6,464,008 B1 10/2002 Roddy et al.
7,055,598 B2 6/2006 Ross et al.
7,861,788 B2 * 1/2011 Tips ..... E21B 33/14 166/319
7,866,402 B2 1/2011 Williamson, Jr.
7,909,095 B2 3/2011 Richards et al.
7,926,573 B2 4/2011 Swan et al.
8,096,363 B2 1/2012 Williamson, Jr.
8,267,178 B1 9/2012 Sommers et al.
8,479,822 B2 7/2013 Hofman et al.
9,121,247 B2 * 9/2015 George ..... E21B 34/063
2002/0166665 A1 * 11/2002 Vincent ..... E21B 21/103 166/291
2004/0129423 A1 * 7/2004 Eddison ..... E21B 21/103 166/321
2005/0072575 A1 4/2005 Yeo et al.
2007/0272411 A1 11/2007 Lopez De Cardenas et al.
2007/0272415 A1 * 11/2007 Ratliff ..... E21B 33/035 166/368
2008/0302538 A1 12/2008 Hofman
2009/0095463 A1 * 4/2009 Swan ..... E21B 21/103 166/53
2009/0095486 A1 4/2009 Williamson, Jr.
2009/0308588 A1 12/2009 Howell et al.
2010/0084130 A1 * 4/2010 Richards ..... E21B 21/103 166/250.08
2010/0314562 A1 12/2010 Bisset
2011/0030975 A1 * 2/2011 Duphorne ..... E21B 23/006 166/386
2011/0100643 A1 * 5/2011 Themig ..... E21B 34/102 166/373
2011/0174491 A1 7/2011 Ravensbergen et al.
2011/0308817 A1 * 12/2011 Ravensbergen ..... E21B 34/102 166/382
2012/0097397 A1 * 4/2012 Hofman ..... E21B 43/12 166/308.1
2012/0261131 A1 * 10/2012 Hofman ..... E21B 34/14 166/316
2013/0056206 A1 * 3/2013 Jackson ..... E21B 34/102 166/281
2013/0056220 A1 * 3/2013 Sommers ..... E21B 34/102 166/373
2014/0048271 A1 * 2/2014 Coon ..... E21B 34/102 166/308.1
2014/0251636 A1 * 9/2014 Hofman ..... E21B 34/063 166/373
2015/0369007 A1 * 12/2015 George ..... E21B 34/108 166/305.1

* cited by examiner

DOWNHOLE TOOL

CROSS-REFERENCES TO RELATED APPLICATIONS

This original nonprovisional application claims the benefit of U.S. Provisional Application Ser. No. 61/729,264, filed Nov. 21, 2012 and entitled "Downhole Tool," which is incorporated by reference herein. Furthermore, this original nonprovisional application is a continuation-in-part of U.S. application Ser. No. 13/462,810, filed May 2, 2012, which claims the benefit of U.S. provisional application Ser. No. 61/481,483, filed May 2, 2011, each of which is incorporated by reference herein.

STATEMENT REGARDING FEDERALLY SPONSORED RESEARCH OR DEVELOPMENT

Not applicable.

BACKGROUND

1. Field of the Invention

The described embodiments and invention as claimed relate to oil and natural gas production. More specifically, the invention as claimed relates to a downhole tool used to selectively activate in response to fluid pressure.

2. Description of the Related Art

In completion of oil and gas wells, tubing is often inserted into the well to function as a flow path for treating fluids into the well and for production of hydrocarbons from the well. Such tubing may help preserve casing integrity, optimize production, or serve other purposes. Such tubing may be described or labeled as casing, production tubing, liners, tubulars, or other terms. The term "tubing" as used in this disclosure and the claims is not limited to any particular type, shape, size or installation of tubular goods.

To fulfill these purposes, the tubing must maintain structural integrity against the pressures and pressure cycles it will encounter during its functional life. To test this integrity, operators will install the tubing with a closed "toe"—the end of the tubing furthest from the wellhead—and then subject the tubing to a series of pressure tests. These tests are designed to demonstrate whether the tubing will hold the pressures for which it was designed.

One detriment to these pressure tests is the necessity for a closed toe. After pressure testing, the toe must be opened to allow for free flow of fluids through the tubing so that further operations may take place. While formation characteristics, cement, or other factors may still restrict fluid flow, the presence of such factors do not alleviate the desirability or necessity for opening the toe of the tubing. Commonly, the toe is opened by positioning a perforating device in the toe and either explosively or abrasively perforating the tubing to create one or more openings. Perforating, however, requires additional time and equipment that increase the cost of the well. Therefore, there exists a need for an improved method of opening the toe of the tubing after it is installed and pressure tested.

The present disclosure describes an improved device and method for opening the toe of tubing installed in a well. Further, the device and method may be readily adapted to other well applications as well.

SUMMARY

The described embodiments of the present disclosure address the problems associated with the closed toe required for pressure testing tubing installed in a well. Further, in one aspect of the present disclosure, a chamber, such as a pressure chamber, air chamber, or atmospheric chamber, is in fluid communication with at least one surface of the shifting element of the device. The chamber is isolated from the interior of the tubing such that fluid pressure inside the tubing is not transferred to the chamber. A second surface of the shifting sleeve is in fluid communication with the interior of the tubing. Application of fluid pressure on the interior of the tubing thereby creates a pressure differential across the shifting element, applying force tending to shift the shifting element in the direction of the pressure chamber, atmospheric chamber, or air chamber.

In a further aspect of the present disclosure, the shifting sleeve is encased in an enclosure such that all surfaces of the shifting element opposing the chamber are isolated from the fluid, and fluid pressure, in the interior of the tubing. Upon occurrence of some pre-determined event—such as a minimum fluid pressure, the presence of acid, or electromagnetic signal—at least one surface of the shifting element is exposed to the fluid pressure from the interior of the tubing, creating differential pressure across the shifting sleeve. Specifically, the pressure differential is created relative to the pressure in the chamber, and applies a force on the shifting element in a desired direction. Such force activates the tool.

While specific predetermined events are stated above, any event or signal communicable to the device may be used to expose at least one surface of the shifting element to pressure from the interior of the tubing.

In a further aspect, the downhole tool comprises an inner sleeve with a plurality of sleeve ports. A housing is positioned radially outwardly of the inner sleeve, with the housing and inner sleeve partially defining a space radially therebetween. The space, which is preferably annular, is occupied by a shifting element, which may be a shifting sleeve. A fluid path extends between the interior flowpath of the tool and the space. A fluid control device, which is preferably a burst disk, occupies at least a portion of the fluid path.

When the toe is closed, the shifting sleeve is in a first position between the housing ports and the sleeve ports to prevent fluid flow between the interior flowpath and exterior of the tool. A control member is installed to prevent or limit movement of the shifting sleeve until a predetermined internal tubing pressure or internal flowpath pressure is reached. Such member may be a fluid control device which selectively permits fluid flow, and thus pressure communication, into the annular space to cause a differential pressure across the shifting sleeve. Any device, including, without limitation, shear pins, springs, and seals, may be used provided such device allows movement of the shifting element, such as shifting sleeve, only after a predetermined internal tubing pressure or other predetermined event occurs. In a preferred embodiment, the fluid control device will permit fluid flow into the annular space only after it is exposed to a predetermined differential pressure. When this differential pressure is reached, the fluid control device allows fluid flow, the shifting sleeve is moved to a second position, the toe is opened, and communication may occur through the housing and sleeve ports between the interior flowpath and exterior flowpath of the tool.

BRIEF DESCRIPTION OF THE SEVERAL VIEWS OF THE DRAWINGS

FIGS. 1A & 2A are enlarged views of sections of FIGS. 1 & 2 respectively.

FIGS. 5A-5C are partial sectional side elevations that collectively show a second embodiment of the tool in the closed position.

FIGS. 7A-7C are partial sectional side elevations that collectively show the second embodiment in a shifted position.

FIGS. 8A-8C are partial sectional side elevations that show the second embodiment in an open position.

DETAILED DESCRIPTION OF VARIOUS EMBODIMENTS

When used with reference to the figures, unless otherwise specified, the terms "upwell," "above," "top," "upper," "downwell," "below," "bottom," "lower," and like terms are used relative to the direction of normal production and/or flow of fluids and or gas through the tool and wellbore. Thus, normal production results in migration through the wellbore and production string from the downwell to upwell direction without regard to whether the tubing string is disposed in a vertical wellbore, a horizontal wellbore, or some combination of both. Similarly, during the fracing process, fracing fluids and/or gasses move from the surface in the downwell direction to the portion of the tubing string within the formation.

Figure 1:
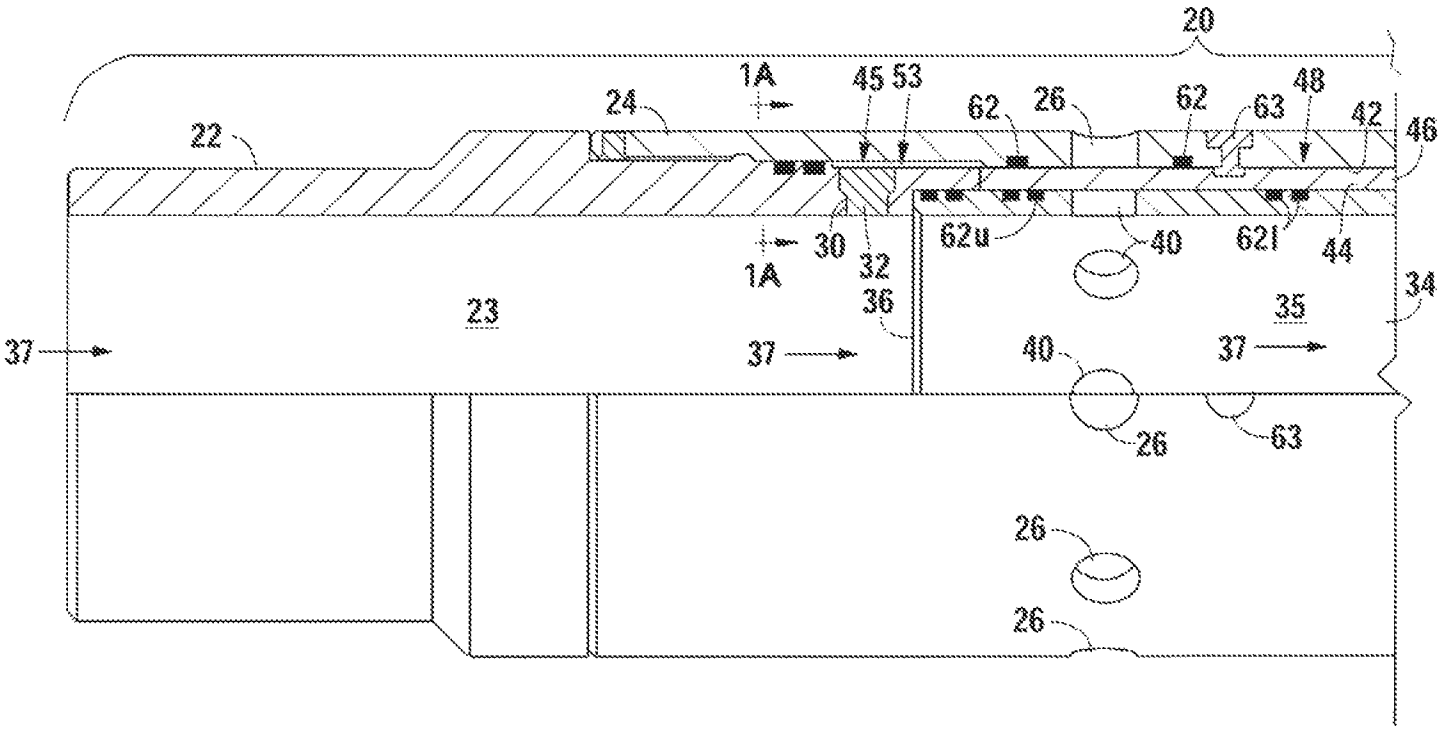
FIGS. 1-2 are partial sectional side elevations of a preferred embodiment in the closed position.
Figure 4B:
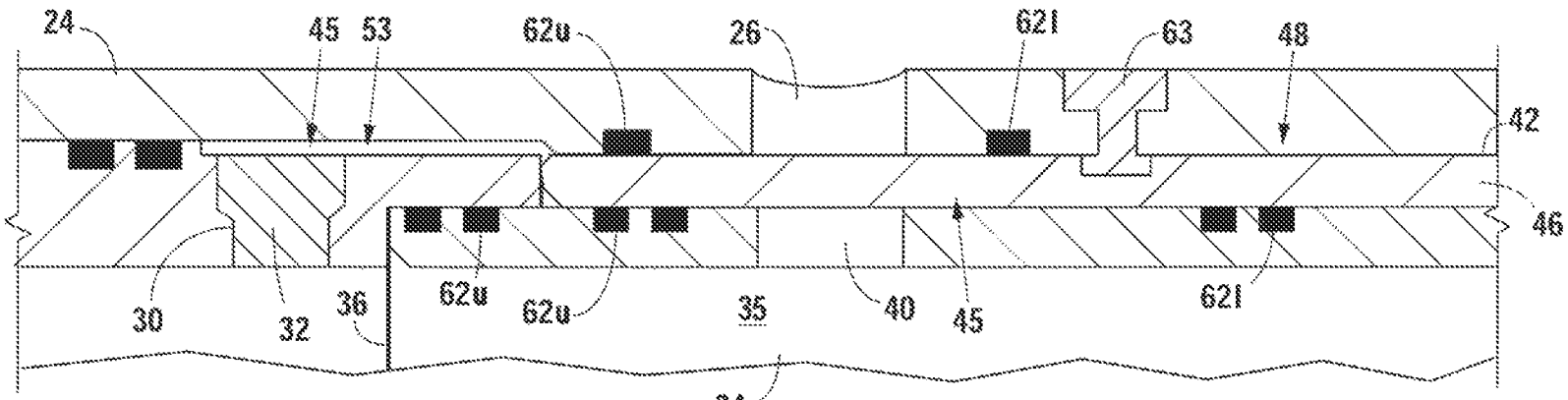
FIGS. 3-4 are partial sectional side elevations of the preferred embodiment in the open position.
Figure 2:
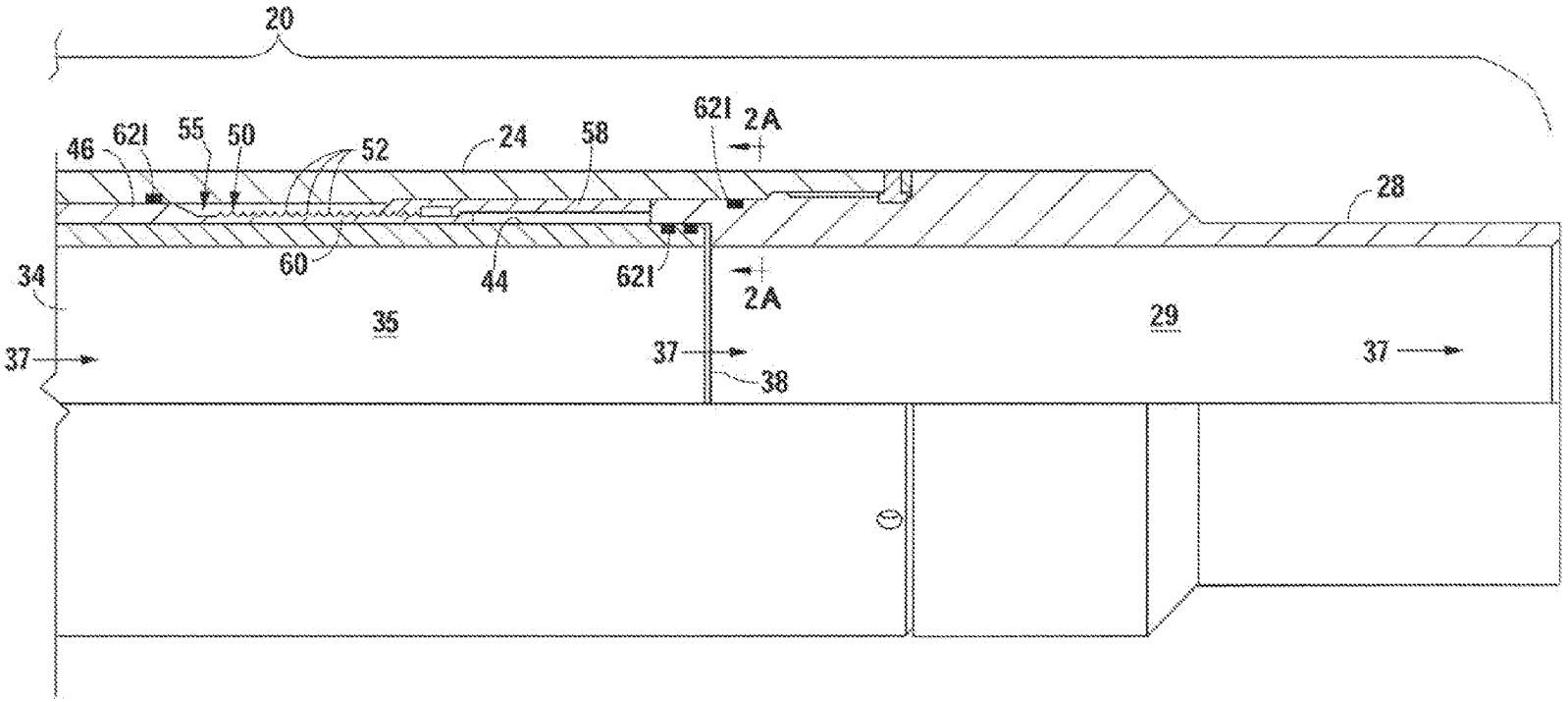
Figure 2B:
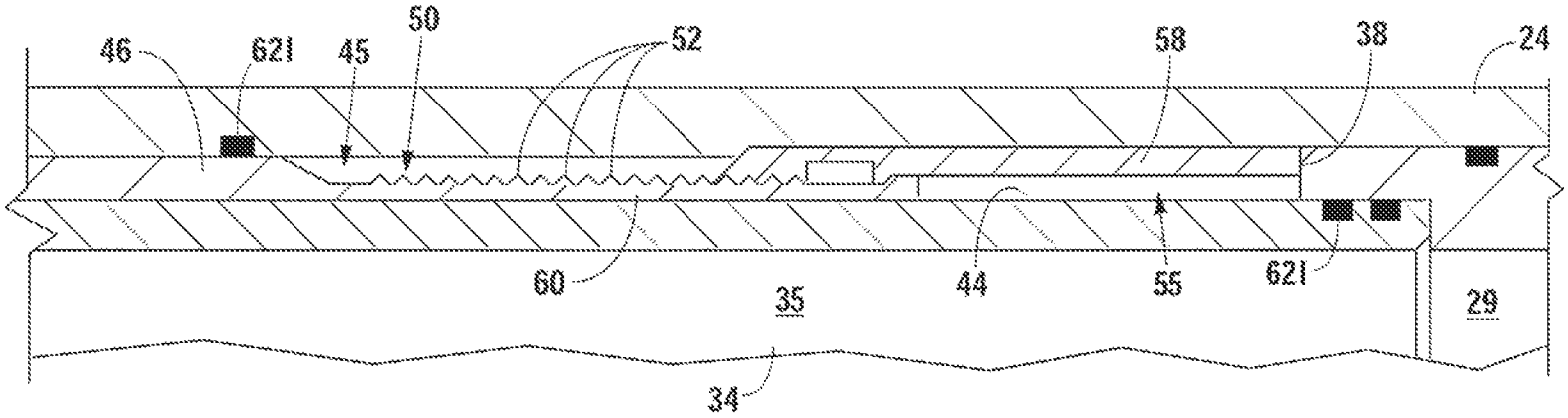

FIGS. 1-2 depict an embodiment 20, which comprises a top connection 22 threaded to a top end of ported housing 24 having a plurality of radially-aligned housing ports 26. A bottom connection 28 is threaded to the bottom end of the ported housing 24. The top and bottom connections 22, 28 have cylindrical inner surfaces 23, 29, respectively. A fluid path 30 through the wall of the top connection 22 is filled with a burst disk 32 having a rated pressure that will rupture when a pressure is applied to the interior of the tool 22 that exceeds the rated pressure.

The embodiment 20 includes an inner sleeve 34 having a cylindrical inner surface 35 positioned between a lower annular shoulder surface 36 of the top connection 22 and an upper annular shoulder surface 38 of the bottom connection 28. The inner sleeve 34 has a plurality of radially aligned sleeve ports 40. Each of the sleeve ports 40 is axially aligned with a corresponding housing port 26. The inner surfaces 23, 29 of the top and bottom connections 22, 28 and the inner surface 35 of the sleeve 34 define an interior flowpath 37 for the movement of fluids into, out of, and through the tool. In an alternative embodiment, the interior flowpath 37 may be defined, in whole or in part, by the inner surface of the shifting sleeve.

Although the housing ports 26 and sleeve ports 40 are shown as cylindrical channels between the exterior and interior of the tool 20, the ports 26, 40 may be of any shape sufficient to facilitate the flow of fluid therethrough for the specific application of the tool. For example, larger ports may be used to increase flow volumes, while smaller ports may be used to reduce cement contact in cemented applications. Moreover, while preferably axially aligned, each of the sleeve ports 40 need not be axially aligned with its corresponding housing port 26.

The top connection 22, the bottom connection 28, an interior surface 42 of the ported housing 24, and an exterior surface 44 of the inner sleeve 34 define an annular space 45, which is partially occupied by a shifting sleeve 46 having an upper portion 48 and a lower locking portion 50 having a plurality of radially-outwardly oriented locking dogs 52. Upper sealing elements 62*u* and lower sealing elements 621 provide pressure isolation between the inner sleeve 34 and the shifting sleeve. In an alternative embodiment, the interior flowpath 37 may be defined, in whole or in part, by the inner surface of the shifting sleeve 46.

The annular space 45 comprises an upper pressure chamber 53 defined by the top connection 22, burst disk 32, outer housing 24, inner sleeve 34, shifting sleeve 46, and upper sealing elements 62*u*. The annular space 45 further comprises a lower pressure chamber 55 defined by the bottom connection 28, the ported housing 24, the inner sleeve 34, the shifting sleeve 46, and lower sealing elements 621. In one embodiment, the pressure within the upper and lower pressure chambers 53, 55 is atmospheric when the tool is installed in a well (i.e., the burst disk 32 is intact).

A locking member 58 partially occupies the annular space 45 below the shifting sleeve 46 and ported housing 24. When the shifting sleeve 46 is shifted as described hereafter, the locking dogs 52 engage the locking member 58 and inhibit movement of the shifting sleeve 46 toward the shifting sleeve's first position.

The shifting sleeve 46 is moveable within the annular space 45 between a first position and a second position by application of hydraulic pressure to the tool 20. When the shifting sleeve 46 is in the first position, which is shown in FIGS. 1-2, fluid flow from the interior to the exterior of the tool through the housing ports 26 and sleeve ports 40 is impeded by the shifting sleeve 46 and surrounding sealing elements 62. Shear pins 63 may extend through the ported housing 24 and engage the shifting sleeve 46 to prevent unintended movement toward the second position, such as during installation of the tool 20 into the well. Although shear pins 63 function in such a manner as a secondary safety device, alternative embodiments contemplate operation without the shear pins 63. For example, the downhole tool may be installed with the lower pressure chamber 55 containing fluid at a higher pressure than the upper pressure chamber 53, which would tend to move and hold the shifting sleeve in the direction of the upper pressure chamber.

To shift the sleeve 46 to the second position (shown in FIG. 3-4), a pressure greater than the rated pressure of the burst disk 32 is applied to the interior (i.e., flowpath 37) of the tool 20, which may be done using conventional techniques known in the art. This causes the burst disk 32 to rupture and allows fluid to flow through the fluid path 30 to the annular space 45. In some embodiments, the pressure rating of the burst disk 32 may be lowered by subjecting the burst disk 32 to multiple pressure cycles. Thus, the burst disk 32 may ultimately be ruptured by a pressure which is lower than the burst disk's 32 initial pressure rating.

Figure 3:
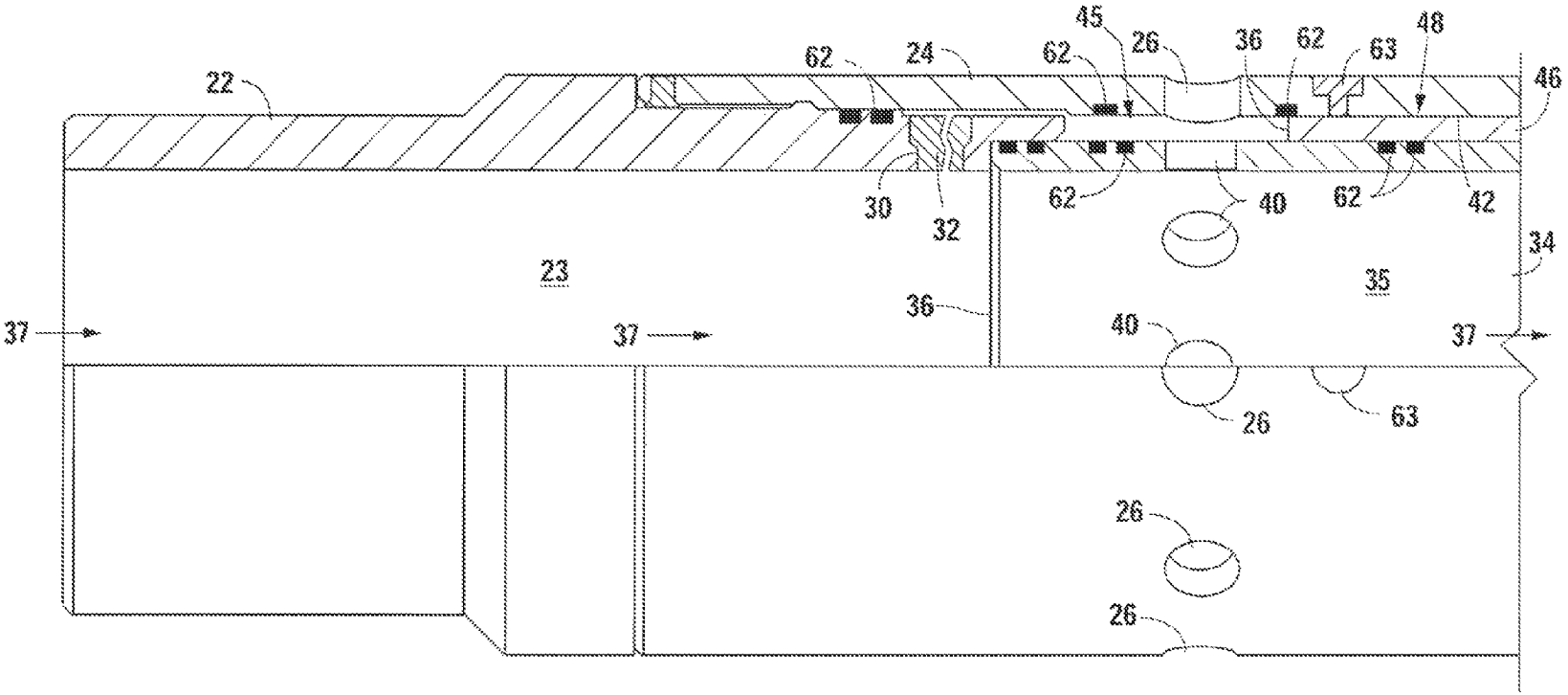
Figure 4:
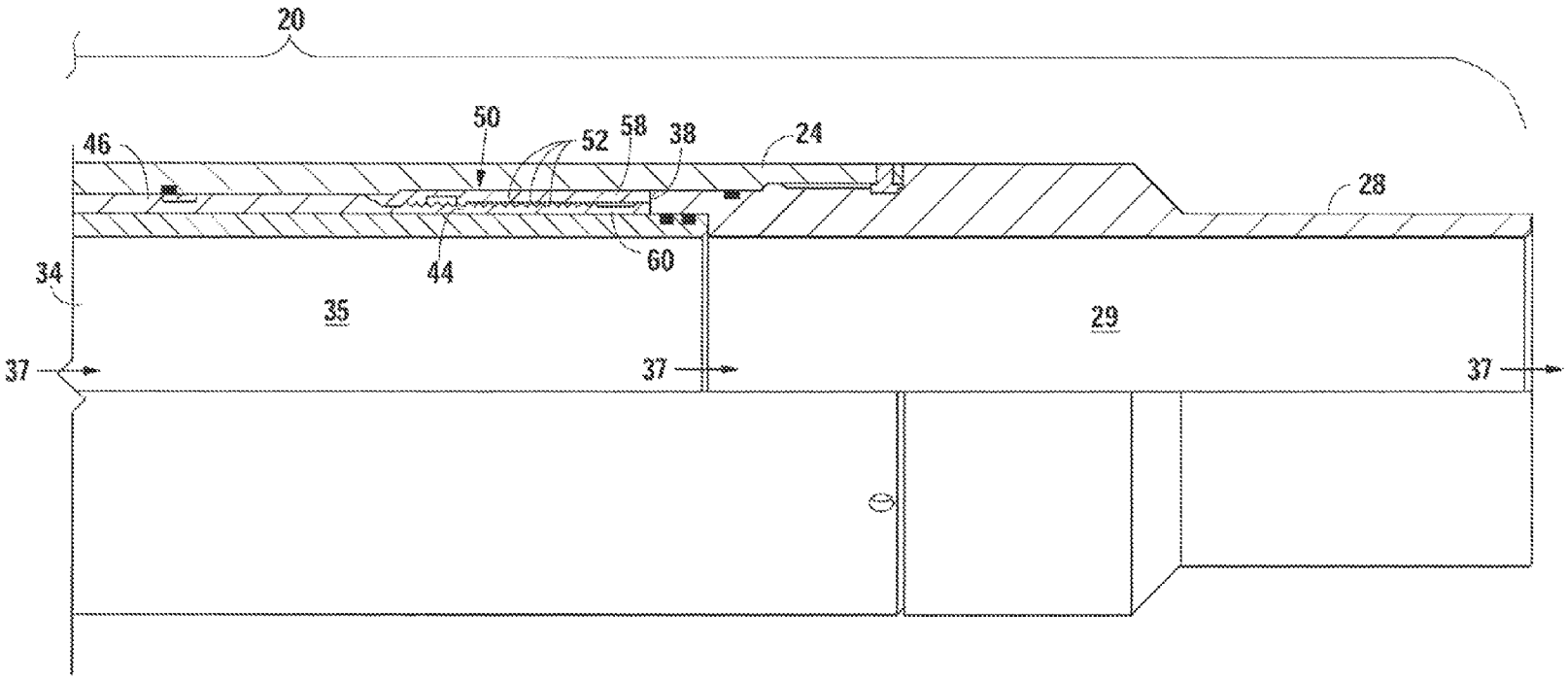

Following rupture of the burst disk 32, the shifting sleeve 46 is no longer isolated from the fluid flowing through the inner sleeve 34. The resultant increased pressure on the shifting sleeve 46 surfaces in fluid communication with the upper pressure chamber 53 creates a pressure differential relative to the atmospheric pressure within the lower pressure chamber 55. Such pressure differential across the shifting sleeve causes the shifting sleeve 46 to move from the first position to the second position shown in FIG. 3-4, provided the force applied from the pressure differential is sufficient to overcome the shear pins 63, if present. In the second position, the shifting sleeve 46 does not impede fluid flow through the housing ports 26 and sleeve ports 40, thus allowing fluid flow between the interior flow path 37 and the exterior of the tool. As the shifting sleeve 46 moves to the second position, the locking member 58 engages the locking dogs 52 to prevent subsequent upwell movement of the sleeve 46.

The arrangement of a housing with an inner sleeve therein and shifting sleeve between the housing and inner sleeve may be referred to as a nested sleeve assembly. In some embodiments, the shifting sleeve 46 of a nested sleeve assembly has pressure surfaces, such as the opposing ends of the shifting sleeve 46, isolated from the interior flowpath 37 and any fluid or fluid pressure therein. A fluid control device, such as a burst disk 32 disposed in a fluid path 30 from the interior flowpath 37 to the annular space 45, or other mechanism may be included to allow fluid communication between the interior flowpath and at least one of the pressure surfaces.

The downhole tool may be placed in positions other than the toe of the tubing, provided that sufficient internal flowpath pressure can be applied at a desired point in time to create the necessary pressure differential on the shifting sleeve. In certain embodiments, the internal flowpath pressure must be sufficient to rupture the burst disk, shear the shear pin, or otherwise overcome a pressure sensitive control element. However, other control devices not responsive to pressure may be desirable for the present device when not installed in the toe.

The downhole tool as described may be adapted to activate tools associated with the tubing rather than to open a flow path from the interior to the exterior of the tubing. Such associated tools may include a mechanical or electrical device that signals or otherwise indicates that the burst disk or other flow control device has been breached. Such a device may be useful to indicate the pressures a tubing string experiences at a particular point or points along its length. In other embodiments, the device may, when activated, trigger release of one section of tubing from the adjacent section of tubing or tool. For example, the shifting element may be configured to mechanically release a latch holding two sections of tubing together. Any other tool may be used in conjunction with, or as part of, the tool of the present disclosure provided that the inner member selectively moves within the space in response to fluid flow through the flowpath. Numerous such alternate uses will be readily apparent to those who design and use tools for oil and gas wells.

The illustrative embodiments are described with the shifting sleeve's first position being "upwell" or closer to the wellhead in relation to the shifting sleeve's second position, the downhole tool could readily be rotated such that the shifting sleeve's first position is "downwell" or further from the wellhead in relation to the shifting sleeve's second position. In addition, the illustrative embodiments provide possible locations for the flow path, fluid control device, shear pin, inner member, and other structures, and those of ordinary skill in the art will appreciate that the components of the embodiments, when present, may be placed at any operable location in the downhole tool.

Figure 5B:
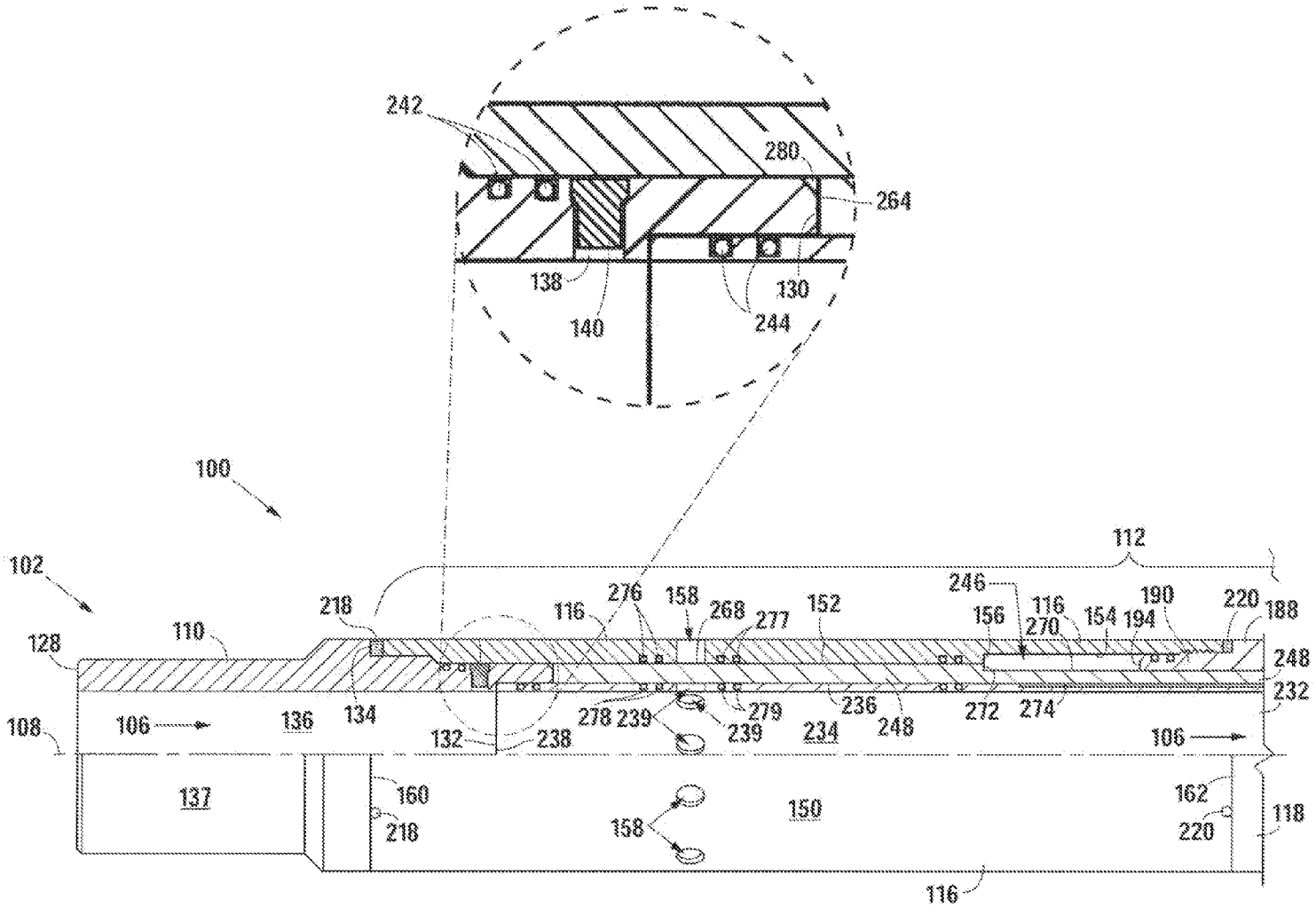
Figure 5B:
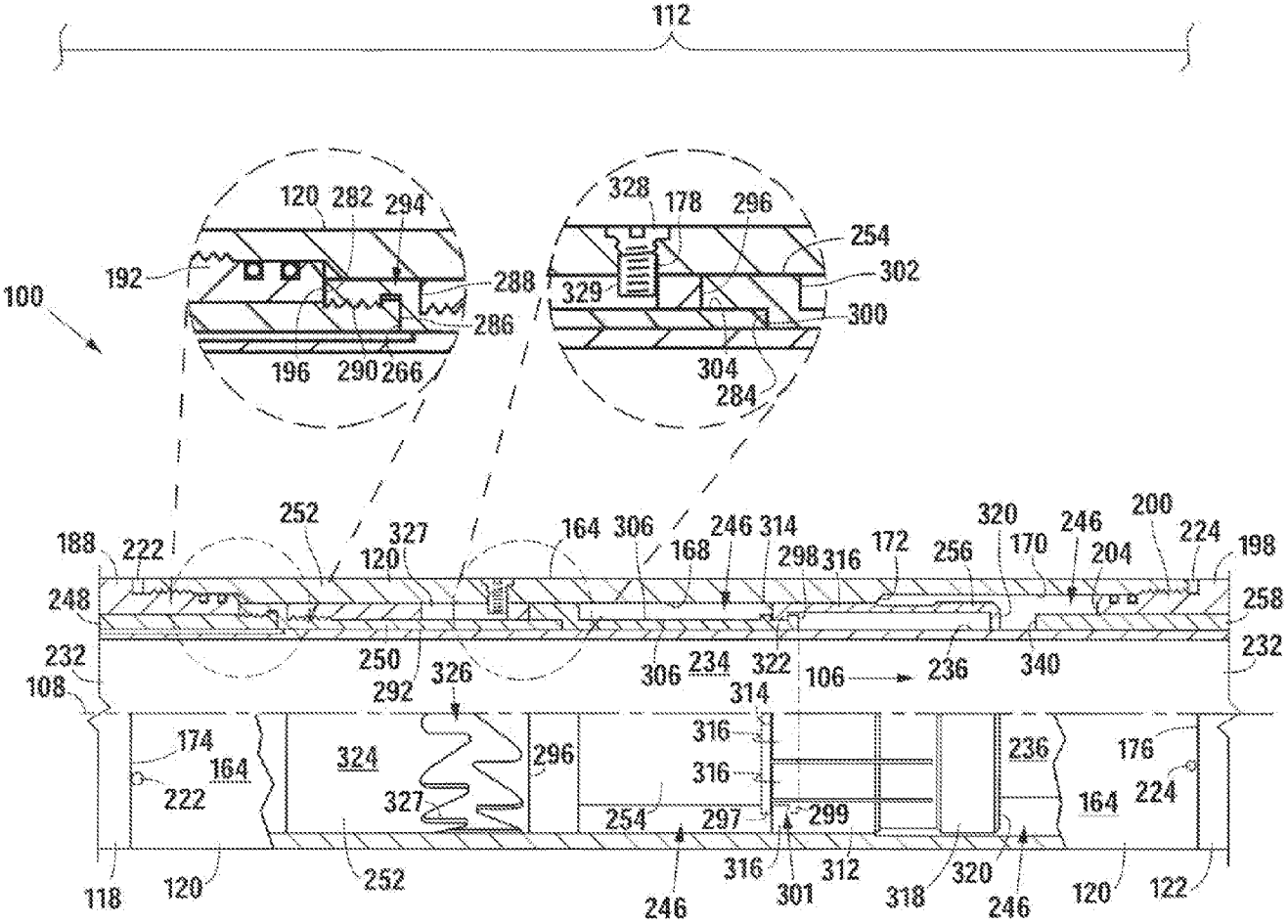
Figure 5C:
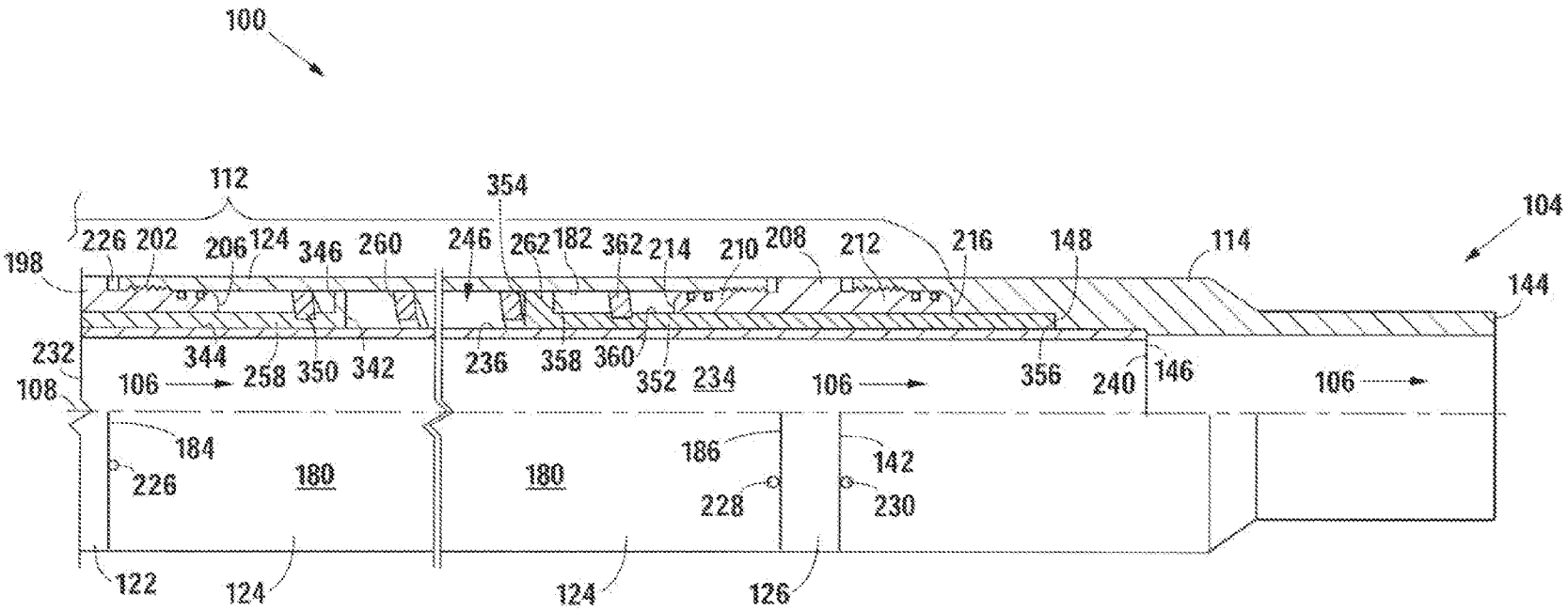

FIGS. 5A-5C together show an alternative embodiment 100 having a first end 102, a second end 104, and a cylindrical flowpath 106 having a longitudinal axis 108 extending between the first end 102 and the second end 104. While the flowpath 106 through the embodiment 100 provides access to the tool exterior at the first end 102 and second end 104, the flowpath 106 is radially separated, relative to the axis 108, from the exterior by a top connection 110, a housing assembly 112, and a bottom connection 114. The housing assembly 112 comprises a ported housing 116, a first housing connector 118, a collet housing 120, a second housing connector 122, a spring housing 124, and a third housing connector 126. Each of the ported housing 116, collet housing 120, and spring housing 124 is a tubular body.

Referring specifically to FIG. 5A, the top connection 110 has a first annular end surface 128, a second annular end surface 130, and first and second annular shoulder surfaces 132, 134 longitudinally positioned between the first and second annular end surfaces 128, 130. The top connection 110 further has a cylindrical inner surface 136 adjacent the first end surface 128, a first shoulder surface 132 that defines a portion of the flowpath 106, and an outer surface 137 adjacent the first end surface 128 and second end surface 130. A fluid path 138 extends radially from the inner surface 136 to the outer surface 137. The fluid path 138 is occupied with a fluid control device, such as a burst disk 140, that will rupture when a pressure is applied to the flowpath 106 that exceeds a rated pressure.

The ported housing 116 has a cylindrical outer surface 150, a cylindrical first inner surface 152, a cylindrical second inner surface 154, an annular shoulder surface 156 separating the first inner surface 152 and the second inner surface 154, and a plurality of circumferentially-aligned, radially-oriented housing ports 158 extending between the outer surface 150 and the first inner surface 152. The ported housing 116 further has first and second annular end surfaces 160, 162 adjacent to the outer surface 150. The first end surface 160 is adjacent to the first inner surface 152, and the second end surface 162 is adjacent to the second inner surface 154.

Referring to FIG. 5B, the collet housing 120 has an outer cylindrical surface 164, a cylindrical first inner surface 168, a cylindrical second inner surface 170, a partially-conical shoulder surface 172 separating the first and second inner surfaces 168, 170, and first and second annular end surfaces 174, 176. The diameter of the first inner surface 168 is less than the diameter of the second inner surface 170. A pin hole 178 extends through the collet housing 120 between the first inner surface 168 and the outer surface 164.

Referring to FIG. 5C, the spring housing 124 has a cylindrical outer surface 180, a cylindrical inner surface 182, and first and second annular end surfaces 184, 186 adjacent to the outer and inner surfaces 180, 182. The bottom connection 114 has a first annular end surface 142, a second annular end surface 144, and first and second annular shoulder surfaces 146, 148 longitudinally positioned between the first and second annular end surfaces 184, 186.

Each of the first housing connector 118, second housing connector 122, and third housing connector 126 are identically constructed. As shown in FIG. 5A-5B, the first housing connector 118 has an annular body portion 188 and first and second annular ends 190, 192 extending away from the body portion 188 terminating in first and second annular end surfaces 194, 196, respectively. As shown in FIG. 5B-5C, the second housing adaptor 122 has an annular body portion 198 and first and second annular ends 200, 202 extending away from the body portion 198 and terminating in first and second annular end surfaces 204, 206, respectively. As shown in FIG. 5C, the third housing adaptor 126 has a body portion 208 and first and second annular ends 210, 212 extending away from the body portion 208 and terminating in first and second annular end surfaces 214, 216, respectively.

Referring back to FIG. 5A, the ported housing 116 is fixed to the top connection 110 with a first set of circumferentially aligned screws 218 and to the first end 190 of the first housing connector 118 with a second set of circumferentially aligned screws 220. As shown in FIG. 5B, the collet housing 120 is connected to the second end 192 of the first housing connector 118 with a third set of circumferentially aligned screws 222 and the first end 200 of the second housing connecter 122 with a fourth set of circumferentially aligned screws 224. As shown in FIG. 5C, the spring housing 124 is connected to a second end 202 of the second housing connector 122 with a fifth set of circumferentially-aligned screws 226 and to the first end 210 of the third housing connector 126 with a sixth set of circumferentially-aligned screws 228. The bottom connection 114 is connected to the second end 212 of the third housing connector 126 with a seventh set of circumferentially aligned screws 230.

Referring again collectively to FIGS. 5A-5C, an inner sleeve 232 is longitudinally fixed between, and relative to, the top connection 110 and the bottom connection 114. The inner sleeve 232 has a cylindrical inner surface 234 that defines a portion of the flowpath 106, a cylindrical outer surface 236, and first and second annular end surfaces 238, 240. The first annular end surface 238 is positioned adjacent to the first shoulder surface 132 of the top connection 110. The second end surface 240 is positioned adjacent to the first shoulder surface 146 of the bottom connection 114. The inner sleeve 232 has a plurality of radially-aligned sleeve ports 239 extending between inner surface 234 and the outer surface 236. Each of the sleeve ports 239 is axially aligned with a corresponding housing port 158 of the ported housing 116.

Annular sealing elements 242 are positioned radially between the top connection 110 and the ported housing 116. Annular sealing elements 244 are positioned radially between the inner sleeve 232 and the top connection 110.

The top connection 110, housing assembly 112, inner sleeve 232 and bottom connection 114 together define an annular space 246 radially positioned relative to the longitudinal axis 108 between the flowpath 106 and the exterior of the embodiment 100. The annular space 246 is occupied by a shifting sleeve 248, a bearing sleeve 250, a slotted member 252, a collet retainer 254, a collet 256, a first spring bearing 258, a coil spring 260, and a second spring bearing 262.

Referring specifically to FIG. 5A, the shifting sleeve 248 is a tubular body coaxially aligned with the inner sleeve 232 around the longitudinal axis 108. The shifting sleeve 248 has a first annular end surface 264, a second annular end surface 266 (see FIG. 5B), a first outer surface 268 having a first diameter, a second outer surface 270 having a second diameter less than the first diameter, an annular shoulder surface 272 separating the first and second outer surfaces 268, 270, and a cylindrical inner surface 274. The inner surface 274 is closely fitted to the outer surface 236 of the inner sleeve 232. The first end surface 264 is adjacent to the second end surface 130 of the top connection 110. Annular sealing elements 276, 277 are positioned radially between the shifting sleeve 248 and the ported housing 116 on either side of the housing ports 158. Annular sealing elements 278, 279 are positioned radially between the shifting sleeve 248 and the inner sleeve 232 on either side of the sleeve ports 239.

An annular chamber 280 intersects with the annular space 246 and the fluid path 138. As shown in FIG. 5A, the chamber 280 is the space defined by the top connection 110, sealing elements 242, 244, 276, 278, the burst disk 140, inner sleeve 232, and the shifting sleeve 248.

Referring to FIG. 5B, the second end surface 266 of the shifting sleeve 248 is adjacent to the bearing sleeve 250, which has a first annular end surface 282 and a second annular end surface 284, an inner shoulder surface 286, and an outer shoulder surface 288. The inner shoulder surface 286 is adjacent to and separates first and second cylindrical inner surfaces 290, 292, of the bearing sleeve 250. The second inner surface 292 is closely fitted to the outer surface 236 of the inner sleeve 232. The first inner surface 290 has a larger diameter than the second inner surface 292 and defines, with the adjacent portion of the inner sleeve 232, an annular space 294 in which the second end surface 266 of the shifting sleeve 248 contacts the inner shoulder surface 286. The first annular end surface 282 is in contact with the second end surface 196 of the first housing connector 118.

The second annular end surface 284 of the bearing sleeve 250 is fitted to the collet retainer 254. The collet retainer 254 has a first annular end surface 296 and a second annular end surface 298, an inner shoulder surface 300, and an outer shoulder surface 302. The inner shoulder surface 300 is adjacent to and separates first and second inner cylindrical surfaces 304, 306. The second inner surface 306 is closely fitted to the outer surface 236 of the inner sleeve 232. The first inner surface 304 has a larger diameter than the second inner surface 306 and, with the adjacent portion of the inner sleeve 236, defines an annular space into which the second end surface 284 of the bearing sleeve 250 is fitted and contacts the inner shoulder surface 300.

First and second annular retaining members 297, 299 define a circumferential retaining groove 301 proximal to the second end surface 298 of the collet retainer 254. The second retainer member 299 coterminates with the second end surface 298 of the collet retainer 254.

The collet 312 is positioned around the second end surface 298 of the collet retainer 254. The collet 312 has a first end 314 coterminating with the ends of collet fingers 316, an annular body 318, and an annular end surface 320 opposing the first end 314. Each collet finger 316 extends from the annular body 318 toward the outer shoulder surface 302 of the retainer 254 and terminates in an inwardly-extending shoulder 322 that coterminates with the first end 314. The fingers 316 are in contact with, and inhibited from radial expansion away from the retainer 254 by, the first inner surface 168 of the collet housing 120. The inwardly-extending shoulder 322 is positioned in the retaining groove 301 defined by the collet retainer 254.

The annular slotted member 252 is positioned around the bearing sleeve 250 and longitudinally between the outer shoulder surface 288 of the bearing sleeve 250 and the first end surface 296 of the collet retainer 254. The slotted member 252 has an outer surface 324 and a slot 326 formed in the outer surface 324. A pin, such as torque pin 328, extends through the pin hole 178 in the collet housing 120 and has a terminal end 329 positioned in the slot 326. The slotted member 252 is concentrically aligned with the axis 108.

Figure 6A:
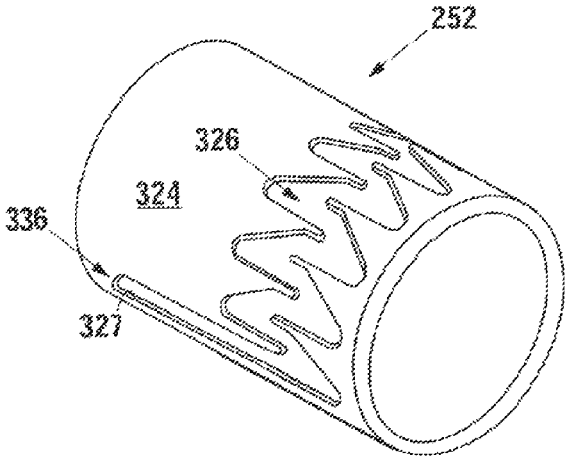
FIGS. 6A-6B show features of the slotted member of the second embodiment.
Figure 6B:
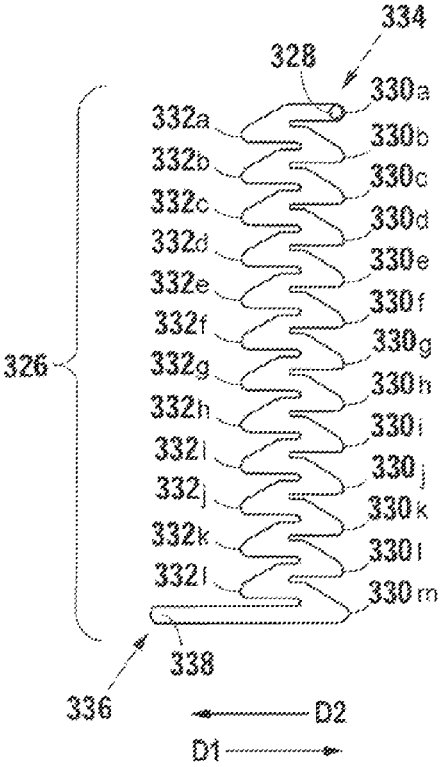

As shown in FIG. 6A-6B, the slot 326 is a continuous path defined by a slot sidewall 327 and extending circumferentially around, and formed in, the outer surface 324 of the slotted member 252. The slot 326 is formed of a repeated pattern of longitudinally-aligned first positions 330*a-m* and longitudinally aligned intermediate positions 332*a-l*. A first end 334 of the slot 326 terminates in the first position 330*a*. A second end 336 of the slot 326 terminates with a second position 338. The intermediate positions 332*a-l* are longitudinally between the first positions 330*a-m* and the second position 338.

The slot 326 is shaped so that when the torque pin 328 is in one of the first positions 330*a-m* and the slotted member 252 moves in a first longitudinal direction D1 relative to the pin 328, the torque pin 328 moves toward the adjacent intermediate position. If the torque pin 328 is in the first position 330*m* and the slotted member 252 moves in the first direction D1, the pin 328 moves toward the second position 338. When the torque pin 328 is in a intermediate position, such as the intermediate position 332*a*, and the slotted member 252 moves in a second longitudinal direction D2 toward the first end 102 of the embodiment 100, the torque pin 328 moves toward the next adjacent first position, first position 330*b*.

Referring back to FIG. 5B-5C, the first spring bearing 258 has an annular first end surface 340, an annular second end surface 342, and an inner cylindrical surface 344 closely fitted to the outer surface 236 of the inner sleeve 232. The first spring bearing 258 is coaxially aligned with the inner sleeve 232. An annular shoulder surface 346 is positioned longitudinally between the first end surface 340 and the second end surface 342. As shown in FIG. 5B, a portion of the first spring bearing 258 is positioned radially between the inner sleeve 232 and the second housing connector 122 and extends past the first end surface 204 of the second housing connector 122 toward the collet 312.

As shown in FIG. 5C, the coil spring 260 is positioned in the annular space 246 longitudinally between the second housing connector 122 and the third housing connector 126, and radially between the inner sleeve 232 and the spring housing 124. The coil spring 260 has a first end 350 positioned between the second end surface 206 of the second housing connector 122 and the shoulder surface 346 of the first spring bearing 258. The first end 350 of the spring 260 is fixed to, and moves longitudinally with, the first spring bearing 258.

A second spring bearing 352 is positioned in the annular space 246, and has a first annular end surface 354 and a second annular end surface 356. An annular shoulder surface 358 is positioned between the first annular surface 354 and the second annular surface 356. The second spring bearing 352 has a cylindrical outer surface 360 positioned radially between the third housing adaptor 126 and the inner sleeve 232. The coil spring 260 has a second end 362 positioned longitudinally between the shoulder surface 358 of second spring bearing 352 and the third housing connector 126.

FIGS. 5A-5C collectively show the embodiment 100 as it may be run into a wellbore, with the second end 104 being located downwell of the first end 102. In this run-in configuration, the pressure in the chamber 280 is atmospheric and the burst disk 140 is intact. As shown in FIG. 5B, the end surface 320 of the collet 312 is spaced a distance from the first end surface 204 of second housing connector 122, and the first end 314 of the collet 312 is around a portion of the collet retainer 254. The first end 314 of the collet 312 is positioned radially within first inner surface 168 of the collet housing 120. The shoulder 322 is positioned in the retaining groove 301, resulting in the collet 312 having a fixed longitudinal relationship with the collet retainer 254. The end 329 of torque pin 328 is positioned in the slot 326 in a first position, such as the first position 330*a* (see FIG. 6). The coil spring 260 is urging the first spring bearing 258 toward the first end 102 of the embodiment 100, which in turn urges the collet 312, collet retainer 254, bearing sleeve 250, and shifting sleeve 248 toward the first end 102 of the embodiment.

As shown in FIG. 5A, the shifting sleeve 248 is moveable within the annular space 246 between a first position and a second position (as will be described with reference to FIGS. 8A-8C) by application of hydraulic pressure to the chamber 280. When the shifting sleeve 248 is in the first position, fluid flow from the flowpath 106 to the exterior of the embodiment through the housing ports 158 and sleeve ports 239 is impeded by the shifting sleeve 248 and surrounding sealing elements 276-279.

Referring to FIG. 5A, to move the shifting sleeve 248, a pressure greater than the rated pressure of the burst disk 140 is applied to the flowpath 106 to rupture burst disk 140 and establish a fluid communication path from the flow path 106 to the chamber 280 through the fluid path 138. Fluid is inhibited from exiting the chamber 280 between the various elements of the embodiment 100 by sealing elements 242, 244, 276, 278.

After the rupture of the burst disk 140, the resultant increased pressure on the first end surface 264 of the shifting sleeve 248 creates a pressure differential relative to the expansive force exerted by the coil spring 260 and the pressure in the remaining portions of the annular space 246, which causes the shifting sleeve 248 to move toward the second end 104 of the embodiment 100. Because of the longitudinally-fixed relationship of the bearing sleeve 250, slotted member 252, collet retainer 254, and collet 312 relative to the shifting sleeve 248, these elements are also moved toward the second end 104, provided the force applied from the pressure differential is sufficient to move these elements and overcome the increasing magnitude of the force resulting from increased compression of the spring 260 under Hooke's law. While the slotted member 252 is longitudinally fixed relative to the bearing sleeve 250 and the collet retainer 254, the slotted member 252 is rotatable around the bearing sleeve 250, subject to the positioning of the torque pin 328 within the slot 326.

Figure 7B:
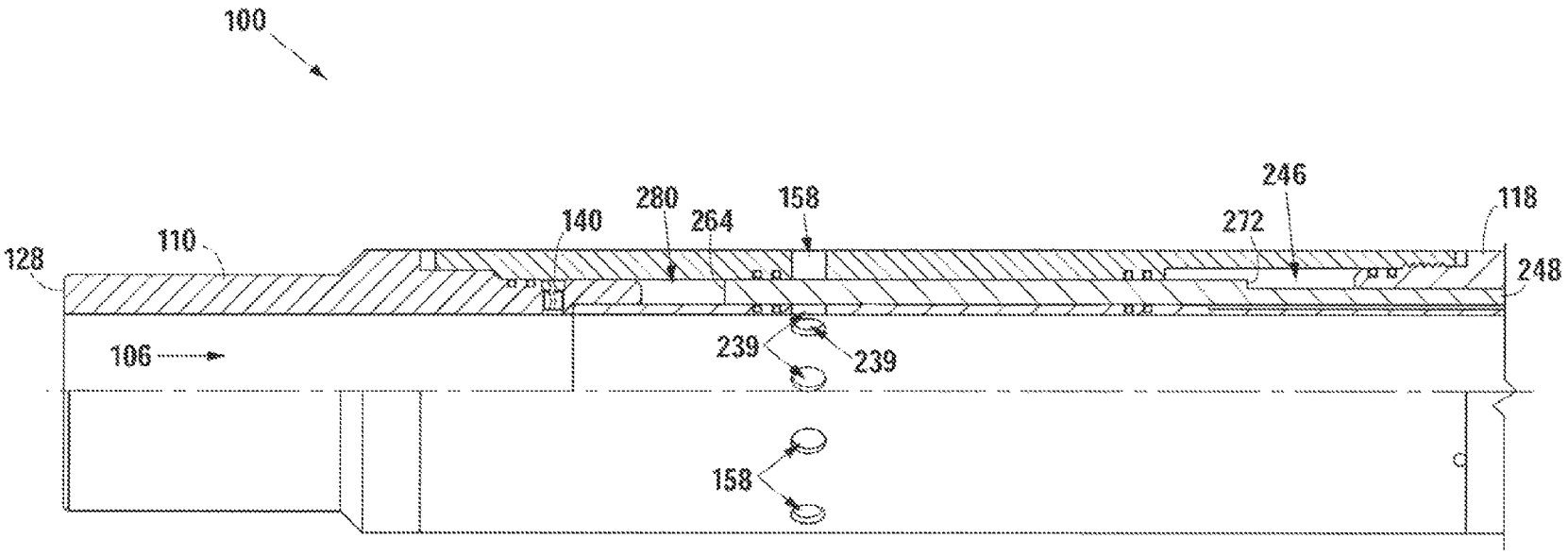
Figure 7B:
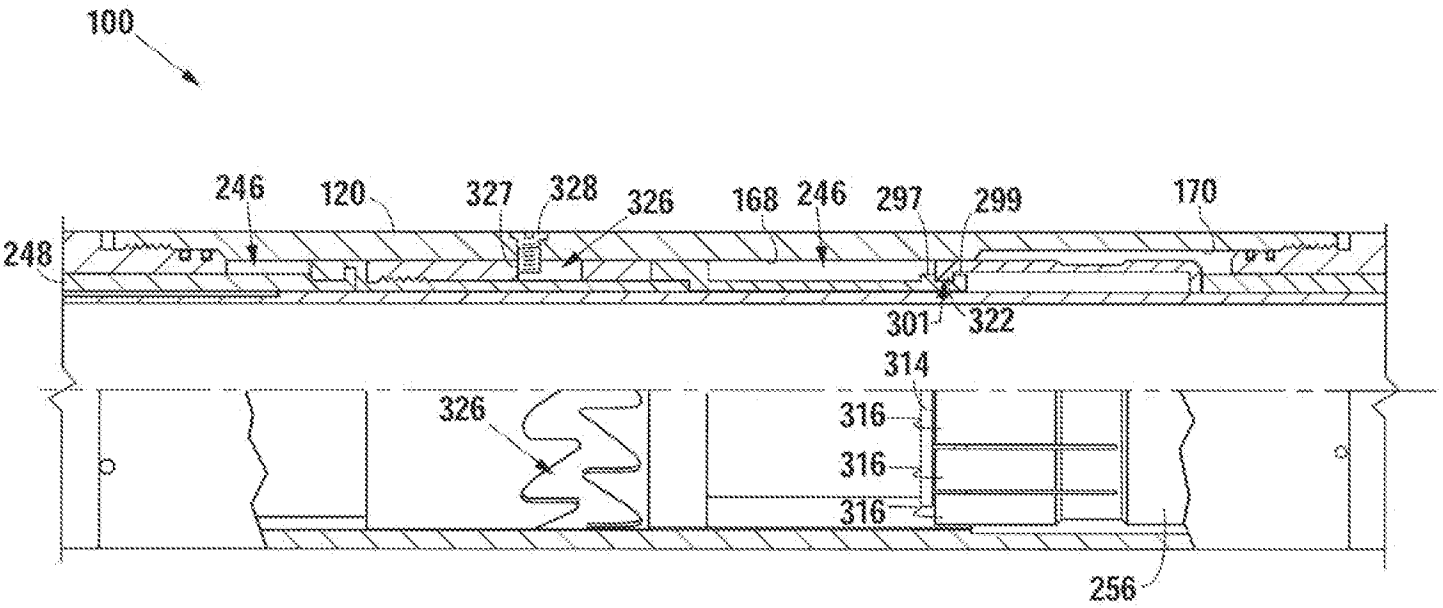
Figure 7C:
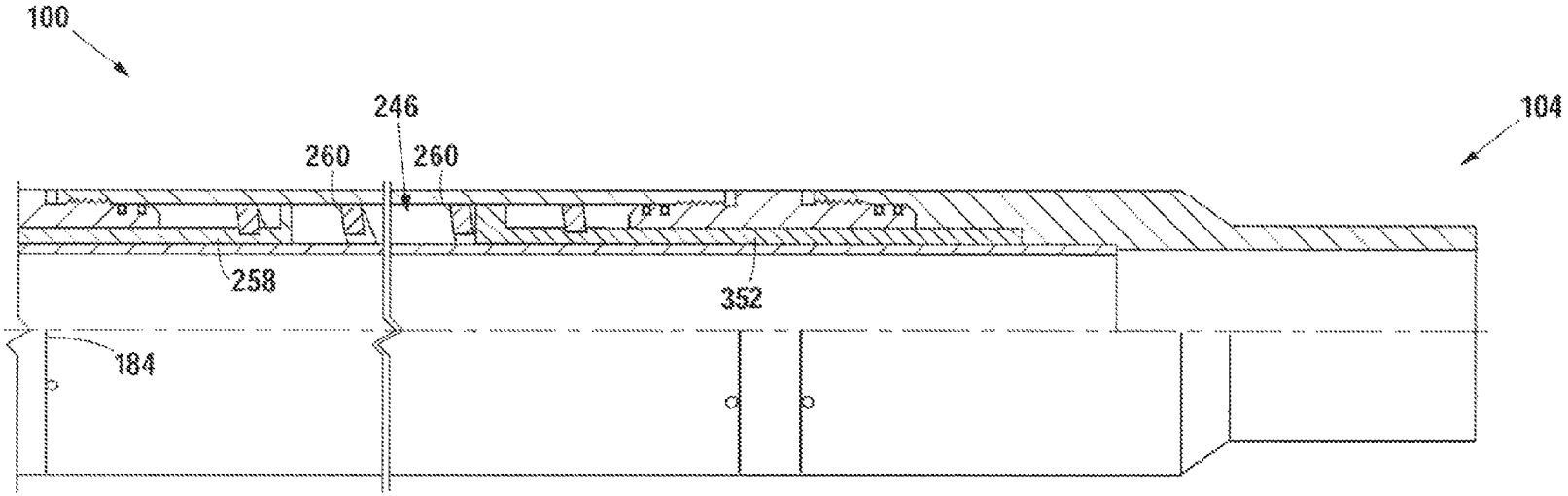

FIGS. 7A-7C collectively show the embodiment with the shifting sleeve 248 and related components in a shifted position. In this position, the torque pin 328 is in one of the first positions of the slot 326. The volume of the chamber 280 is larger than as shown in FIG. 5A because of displacement of the first end surface 264 of the shifting sleeve 248. The collet fingers 316 remain inhibited from radial expansion by the first inner surface 168 of the collet housing 120. Movement past the shifted position shown in FIG. 7A-7C is limited by, inter alia, the position of the torque pin 328 within the slot 326, which is in an intermediate position with the pin 328 in contact with the slot sidewall 327. The coil spring 260 exerts an expansive force on the first and second spring bearings 258, 352, urging the shifting sleeve 248 toward the top connection 110, but the shifting sleeve 248, slotted member 252, collet retainer 254, collet 256, bearing sleeve 250, and first spring bearing 258 are shifted towards the second end 104 into the intermediate position on slot 326 by the fluid pressure in chamber 280.

Following a pressure increase within the flowpath 106, and therefore chamber 280, sufficient to move the shifting sleeve 248 to the shifted position, the pressure may thereafter be decreased to a magnitude at which the expansive force of the spring 260 moves the first spring bearing 258, collet 312, collet retainer 254, bearing sleeve 250, and shifting sleeve 248 to the first position of FIG. 5A-5C. This decrease in pressure marks the end of the pressure cycle.

Figure 8B:
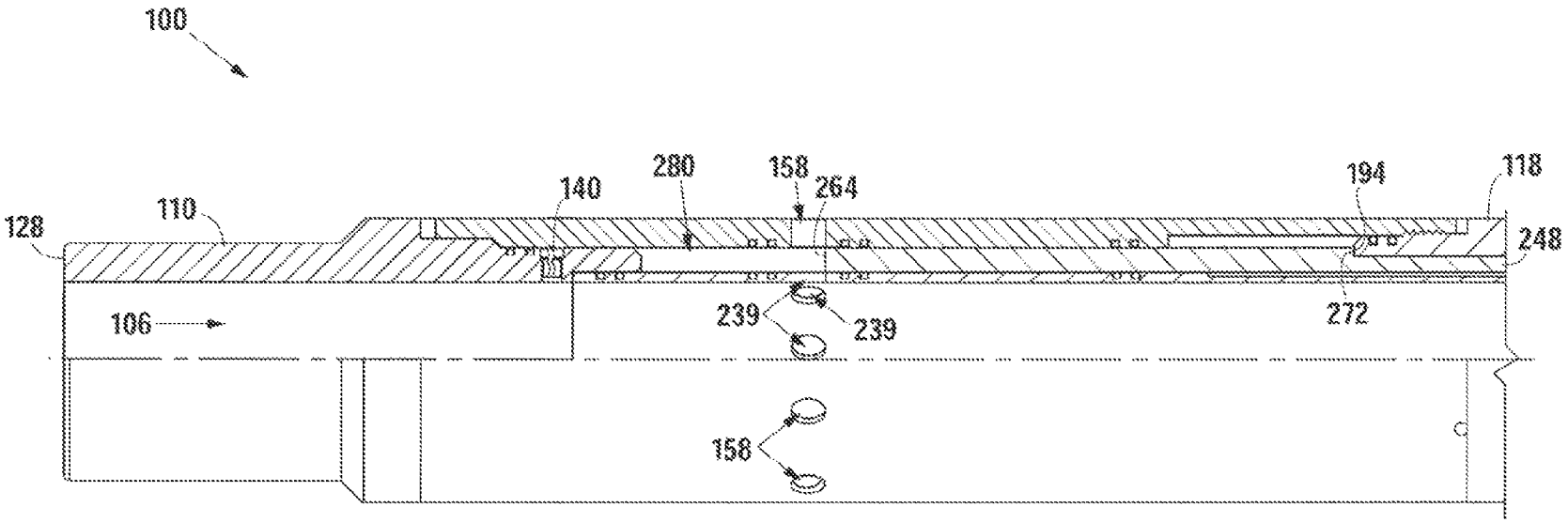
Figure 8B:
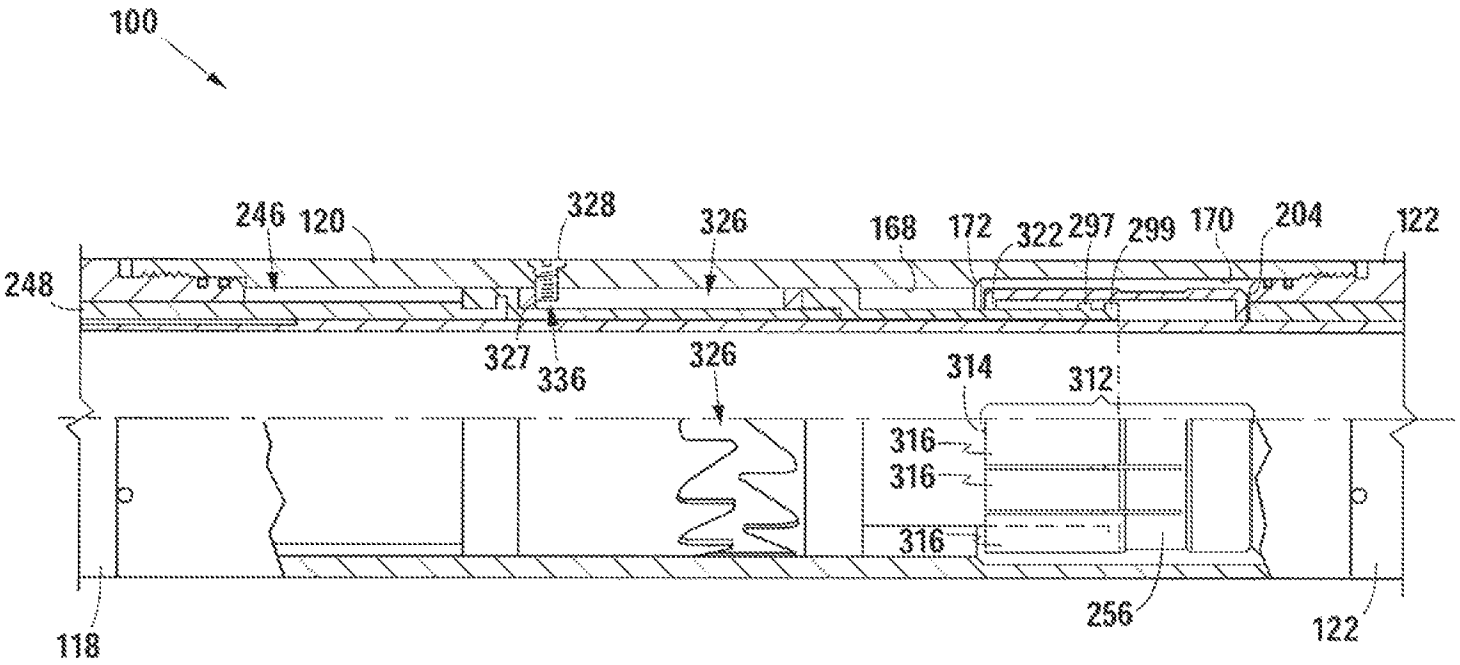
Figure 8C:
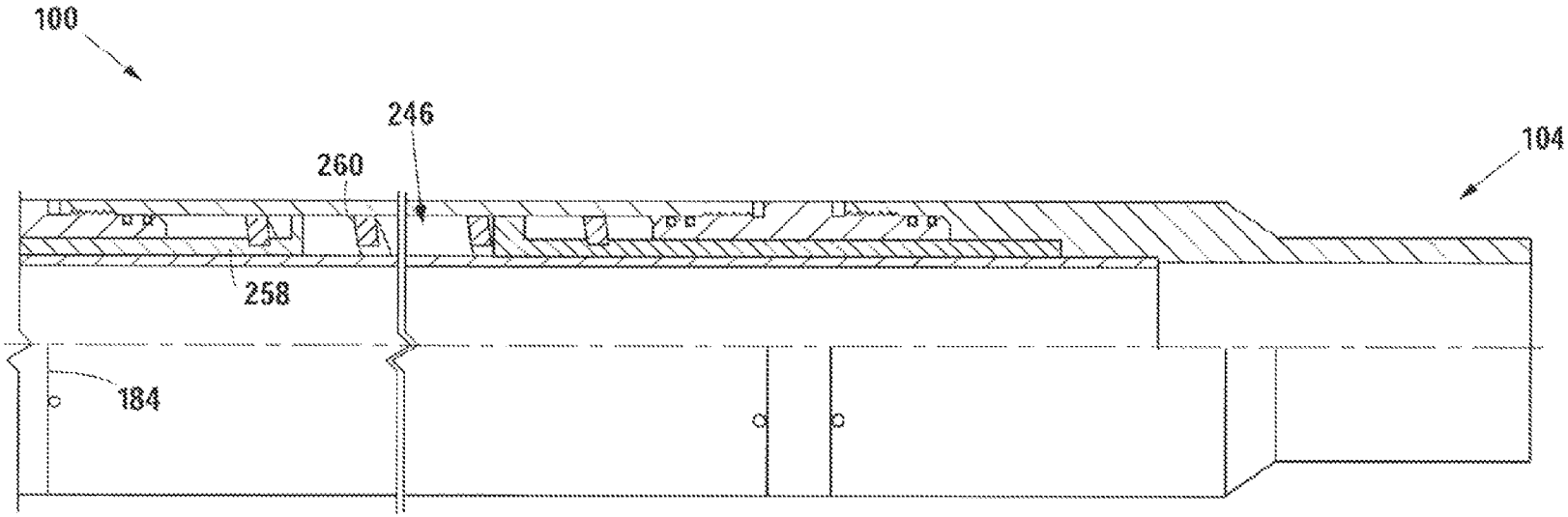

FIGS. 8A-8C collectively show the embodiment 100 with the shifting sleeve 248 and related components in the second position. As shown in FIG. 8A, the first end surface 264 of the shifting sleeve 248 is positioned longitudinally between the housing ports 158 and the first housing connector 118, which allows a fluid communication path between the exterior and the flowpath 106 through the housing ports 158, sleeve ports 239, and chamber 280. The shoulder surface 272 of the shifting sleeve 248 is adjacent to first end surface 194 of the first housing connector 118. As shown in FIG. 8B, the torque pin 328 is in the second end 336 of the slot 326. Movement of the collet 312 toward the second end 104 is limited by the first end surface 204 of the second housing connector 122. Second end 336 may be referred to as the actuated position of the slotted member. Any of the first positions 330*a-m* and the intermediate positions 332*a-l* may be referred to as a non-actuated position and any two or more collectively referred to as non-actuated positions.

The first end 314 of the collet 312 has moved past the shoulder surface 172 into the larger-diameter section defined by the second inner surface 170, which allows collet fingers 316 to radially expand as the collet retainer 254 moves further toward the second housing connector 122. This allows the retaining members 297, 299 to move past the finger shoulders 322, which terminates the fixed longitudinal relationship between the collet retainer 254 and the collet 312. Subsequent movement of the collet 312 toward the top connection 110 is inhibited by engagement of the collet fingers 316 with the shoulder surface 172. After this disengagement, the expansive force of the spring 260 is no longer translated to the shifting sleeve 248 through the collet 312 as described with reference to FIGS. 7A-7C.

One advantage of this embodiment over the embodiment described with reference to FIGS. 1-4 relates to applications in which the well operator may desire to test the tubing string at pressures near the rated pressure of the burst disk 140. Although the burst disk 140 has a rated pressure at which it is intended to rupture, it may rupture unintentionally before the rated pressure within the flowpath 106 is obtained. The closer the test pressure to the rated pressure, the more likely an unintentional rupture of the burst disk 140 that would result in a premature actuation of the embodiment shown in FIGS. 1-4, which may leave the tubing string inoperable for the intended application.

In addition, the embodiment 100 may be particularly useful for applications in which the tubing pressure will be tested multiple times prior to the desired actuation of the tool. Generally, the more frequently the burst disk 140 (or any device intended to fail at a predetermined rating) is subject to increased pressures that approach the rated pressure, the increased likelihood of failure of the burst disk 140 at a pressure lower than the rated pressure.

In either of these cases, the embodiment 100 inhibits unintended opening of the establishment of a fluid communication path and the exterior as follows. In the run-in configuration of FIG. 5A-5C, the torque pin 328 is located in a first position other than position 330*m*. Thus, it will take at least one pressure cycle, with each cycle resulting in an increase in pressure and a decrease in pressure, before the embodiment 100 will actuate, with each cycle requiring a sufficient pressure to overcome the expansive force of the spring 260 and move the shifting sleeve 248 and related elements to the position shown in FIG. 8A-8C. For example, in applications where the well operator desires to cycle pressure within the tubing string a predetermined number of cycles prior to actuation of the tool, the torque pin 328 is positioned in a corresponding first position to require at least the predetermined number of pressure cycles plus one additional pressure cycle. In this way, the slotted member 252, spring 260, and torque pin 360 function as an indexing assembly, and more specifically a mechanical and pressure responsive indexing assembly, by advancing one increment in response to the predetermined stimulus, that is the increase and decrease in fluid pressure applied the interior flowpath 106.

As a specific example, assume the burst disk 140 of the embodiment 100 has a rated burst pressure of 10,200 psi and the well operator desires to cycle the pressure to 10,000 psi three times to test the tubing string as a whole. In this scenario, the embodiment 100 is configured with the torque pin 328 positioned in the first position 330*i*. In the event the burst disk 140 does not rupture during any of the three test pressure cycles, the burst disk will rupture when intended upon application of a pressure of at least 10,200. The embodiment 100 will then be actuated to the position shown in FIG. 8A-8C with an additional four pressure cycles, with each increase in pressure causing movement of the shifting sleeve 248 to the position shown in FIG. 7A-7C and each decrease in the pressure allow the return of the shifting sleeve 248 to the position shown in FIG. 5A-5C by the coil spring 260.

If, however, the burst disk 140 inadvertently ruptures during one of the three pressure-testing cycles, the embodiment 100 prevents inadvertent movement of the shifting sleeve 248. Because the torque pin 328 is initially positioned in first position 330*i*, even if the pressure is sufficient to move the shifting sleeve 248 during one or more of the three test pressure cycles following inadvertent failure of the burst disk 140, the embodiment 100 will not actuate until at least the fourth pressure cycle.

For example, if the burst disk 140 ruptures during the first pressure test cycle and the pressure is sufficient to move the shifting sleeve 248 to the shifted position shown in FIG. 7A-7C, upon conclusion of the first pressure test cycle, the shifting sleeve 248 returns to the first position of FIG. 5A-5C as torque pin 328 advances to the next first position, which in this example is first position 330*j*. During the subsequent two pressure cycles, torque pin 328 again advances to the next first positions 330*k* and 330*l*, such that the next pressure cycle will cause the embodiment 100 to actuate to the position shown in FIG. 8A-8C.

The present disclosure includes preferred or illustrative embodiments in which specific tools are described. Alternative embodiments of such tools can be used in carrying out the invention as claimed and such alternative embodiments are limited only by the claims themselves. Other aspects and advantages of embodiments according to the present disclosure and the invention as claimed may be obtained from a study of this disclosure and the drawings, along with the appended claims.

We claim:

1. A downhole tool having an interior flowpath and an exterior, the tool comprising:

a nested sleeve assembly comprising a shifting sleeve, the shifting sleeve having a first position, a second position, a first end and a second end, the first end and second end each in fluid isolation from the interior flowpath and the exterior; and an indexing assembly in communication with the shifting sleeve, the indexing assembly having, a run in position, an actuated position and at least one non-actuated position between the run in position and the actuated position;

wherein, the indexing assembly advances from a first non-actuated position to the actuated position in response to a predetermined stimulus;

further, wherein the indexing assembly prevents the shifting sleeve from moving to the second position when the indexing assembly is in the at least one non-actuated position; and a collet assembly in communication with the shifting sleeve and the indexing assembly, wherein said collect assembly comprises a collet and a collet retainer;

wherein the collet is connected to the collet retainer and disposed between the shifting sleeve and the indexing assembly;

and further wherein the collet and collet retainer are configured to disconnect in response to movement of the indexing assembly to the actuated position.

2. The downhole tool of claim 1 wherein the indexing assembly comprises a slotted member having a slot with at least one first position, at least one intermediate position and an actuated position, a torque pin; and a spring, wherein the torque pin is engaged with the slot adjacent to the at least one first position and the spring is in communication with the slotted member and resists movement of the slotted member relative to the torque pin in at least one direction.

3. The downhole tool of claim 1 wherein the nested sleeve assembly further comprises:

a housing;

an inner sleeve within the housing, the housing and inner sleeve defining a space therebetween;

a passageway connecting a flowpath with the space;

wherein, the shifting sleeve occupies at least a portion of the space such that a surface of the shifting sleeve is fluidly connectable to the flowpath through the passageway.

4. The downhole tool of claim 1 wherein the nested sleeve assembly further comprises:

a passageway connecting the interior flowpath with the first end; and a fluid control device in the passageway.

5. The downhole tool of claim 4 wherein the fluid control device comprises a burst disk.

6. The downhole tool of claim 1 wherein the indexing assembly is a mechanical indexing assembly.

7. The downhole tool of claim 1 wherein the indexing assembly is a pressure responsive indexing assembly.

8. A method for actuating a downhole tool, the method comprising flowing a fluid into the downhole tool, the downhole tool comprising:

an interior flowpath, an exterior. a nested sleeve assembly and an indexing assembly;

the nested sleeve assembly having a shifting sleeve with a first position and a second position and a passageway;

the shifting sleeve comprising a first end and a second end, the first end and second end in fluid isolation from the interior flowpath and the exterior; and the passageway having a fluid control device therein and connecting the interior flowpath to the first end;

the indexing assembly comprising an indexing element with a run-in position, an actuated position, and at least one non-actuated position therebetween, the indexing assembly in communication with the shifting sleeve;

a collet connected to a collet ring;

changing the fluid control device from a closed state to an opened state;

causing a first increase in pressure of the fluid in the interior flowpath to a first pressure and moving the indexing element to a first unactuated position;

causing a decrease in the pressure of the fluid in the downhole tool to move the indexing element to an actuated position;

reducing a force applied to the indexing element when the indexing element moves to the actuated position, said reducing step comprising disconnecting the collet from the collet ring.

9. The method of claim 8 further comprising decreasing the pressure to a second pressure and moving the indexing element to a second non-actuated position prior to moving the indexing element to the actuated position.

10. The method of claim 8 further comprising rupturing a burst disk disposed in the passageway.

11. The method of claim 8 further comprising rotating the indexing element in response to movement of the indexing element from the first non-actuated position to a second unactuated position.

12. A downhole tool having an exterior, the tool comprising:

a nested sleeve assembly comprising a shifting sleeve, the shifting sleeve having a first position and a second position; and an indexing assembly in communication with the shifting sleeve, the indexing assembly having an actuated position and at least one non-actuated position;

a collet assembly comprising a collet, a collet ring, a first internal surface and a second internal surface;

wherein the indexing assembly advances from the at least one non-actuated position to the actuated position in response to a predetermined stimulus; and the indexing assembly prevents the nested sleeve from moving to the second position when the indexing assembly is in the at least one non-actuated position; and the second internal surface has a diameter sufficient large to permit the collet to release from the collet ring.

13. The downhole tool of claim 12 wherein the first internal surface has a diameter configured to maintain a connection between the collet and the collet ring.

14. The downhole tool of claim 12 wherein the collet is connected to a collet sleeve and the collet ring is connect to a collet ring sleeve, the connection of the collet and the collet ring preventing the collet sleeve from overlapping with the collet ring sleeve.

* * * * *